US007021009B2

(12) United States Patent
Johnson

(10) Patent No.: US 7,021,009 B2
(45) Date of Patent: Apr. 4, 2006

(54) EMERGENCY HOUSING

(75) Inventor: Bruce Johnson, P.O. Box 1147, Marble Hill, MO (US) 63764

(73) Assignee: Bruce Johnson, Anderson, MO (US)

( * ) Notice: Subject to any disclaimer, the term of this patent is extended or adjusted under 35 U.S.C. 154(b) by 0 days.

(21) Appl. No.: 10/365,106

(22) Filed: Feb. 12, 2003

(65) Prior Publication Data

US 2004/0154235 A1 Aug. 12, 2004

(51) Int. Cl.
*E04H 1/00* (2006.01)

(52) U.S. Cl. ..... 52/79.5; 52/79.9; 52/284

(58) Field of Classification Search ..... 52/79.5, 52/79.9, 284, 285.3, 578, 582.1; 404/40, 404/41

See application file for complete search history.

(56) References Cited

U.S. PATENT DOCUMENTS 841,998 A * 1/1907 Mulford ..... 52/584.1
2,595,111 A * 4/1952 Steward ..... 52/582.1
2,924,858 A * 2/1960 Couse et al. ..... 52/586.2
3,235,118 A * 2/1966 Kewley ..... 217/65
3,323,674 A * 6/1967 Nist, Jr. ..... 217/12 R
4,440,363 A * 4/1984 Brand ..... 244/114 R
4,453,471 A * 6/1984 Harrington et al. ..... 108/55.1
4,461,395 A * 7/1984 Burnett ..... 217/12 R
4,796,392 A * 1/1989 Graham, Jr. ..... 52/79.5
5,310,063 A * 5/1994 Skolasinski ..... 206/600
5,713,175 A * 2/1998 Mitchell ..... 52/582.1
6,189,283 B1 * 2/2001 Bentley et al. ..... 52/587.1
6,640,513 B1 * 11/2003 Ku ..... 52/589.1

* cited by examiner

*Primary Examiner*—Ramon O. Ramirez
*Assistant Examiner*—Steven Marsh

(57) ABSTRACT

An emergency and temporary building system. The system allows for a flexible building approach where a variety of structures can be built from the same basic components. The system allows a building to be quickly erected with a few basic tools. Components of the system are assembled using three basic clips. Components of the building system include a flat square panel and a plank having a slanted edge that can be clipped to the panel and to other planks to make a frame to contain the panel. Doors, windows, screens, plumbing and electrical connections can be made by replacing the standard flat panel with special panels for each application.

16 Claims, 11 Drawing Sheets

EMERGENCY HOUSING

BACKGROUND OF THE INVENTION

The present invention relates to emergency or temporary structures. It is known in the industry to provide structures that can be quickly assembled for emergency or temporary use. Such buildings breakdown in some way for shipment to a remote site, assembly usually requires a minimum of tools. Modern building systems take into account the need for electricity, plumbing and the need for communication lines.

SUMMARY OF THE INVENTION

The system uses a basic plank and panel to make up most of the structure. These basic flat pieces can be quickly assembled and secured in place using clips. Though simple in its basic form the system can be adapted with custom pieces for special applications and systems can be combined to make a variety of larger buildings.

BRIEF DESCRIPTION OF A PREFERRED EMBODIMENT OF THE INVENTION

Figure 4:
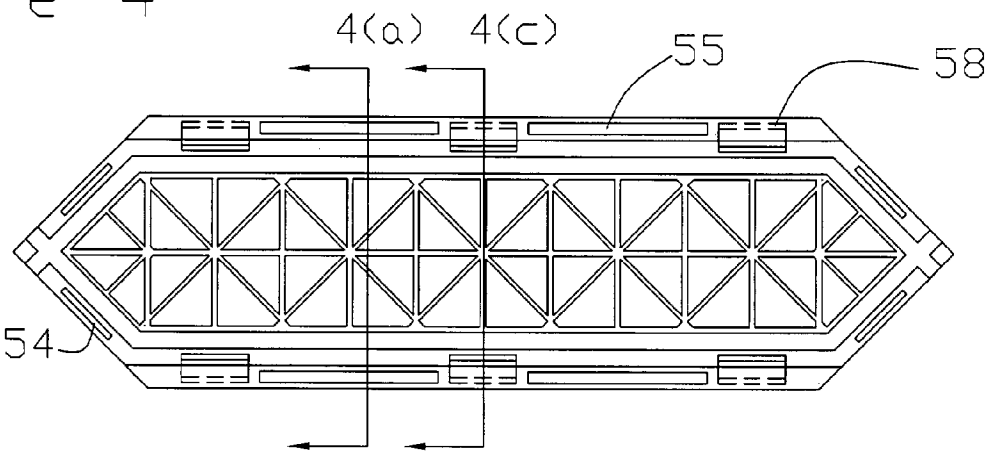
Figure 5:
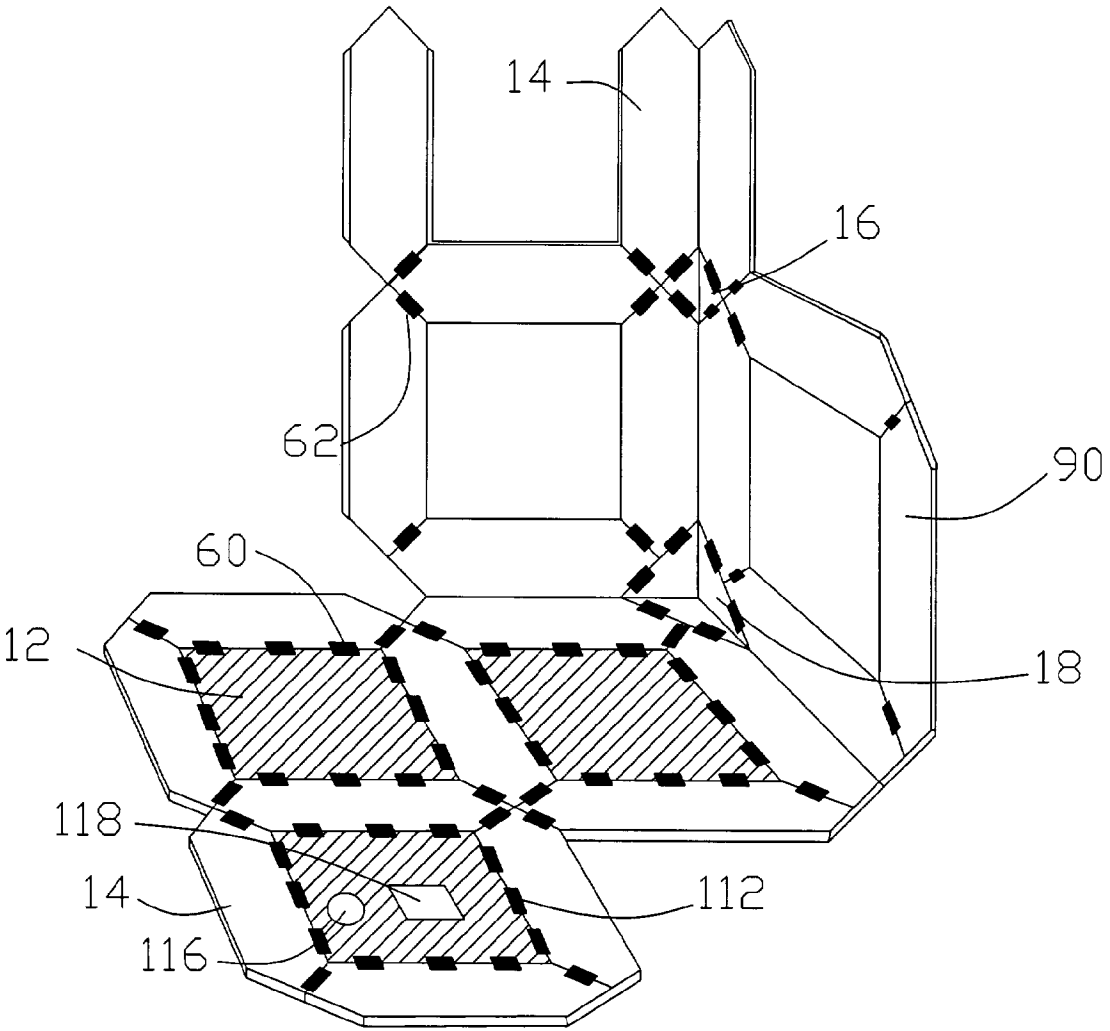
Figure 6A:
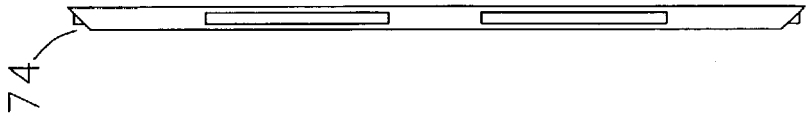
Figure 6:
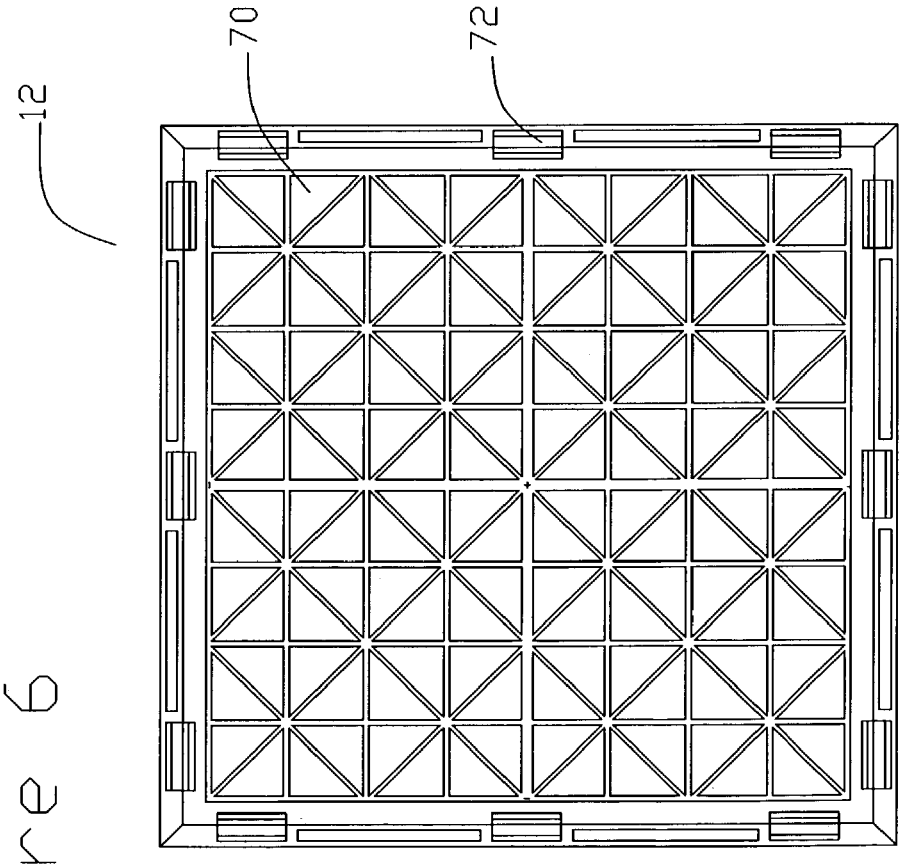
Figure 7:
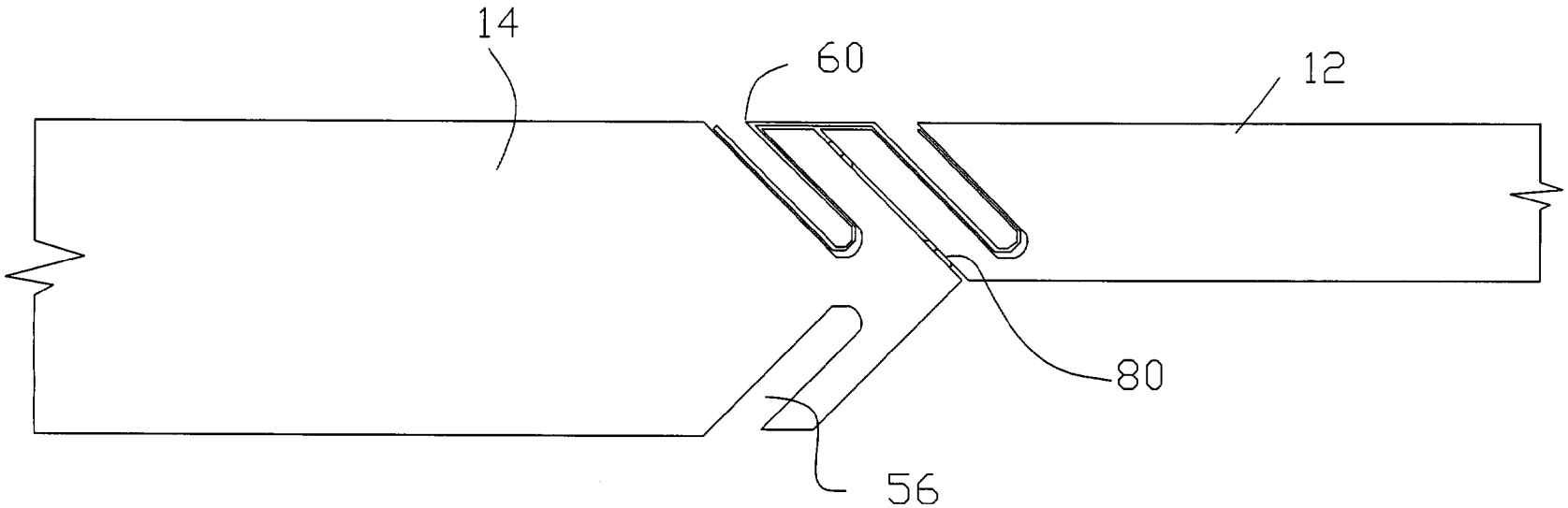
Figure 8:
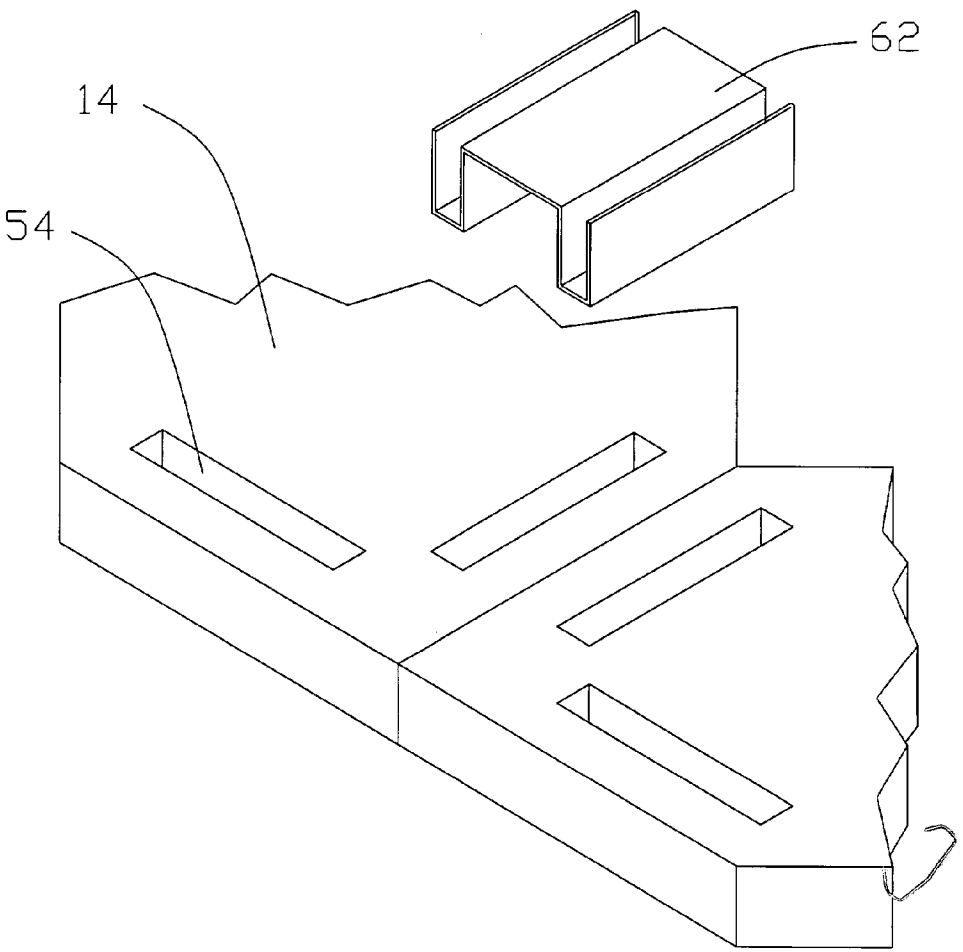
Figure 9:
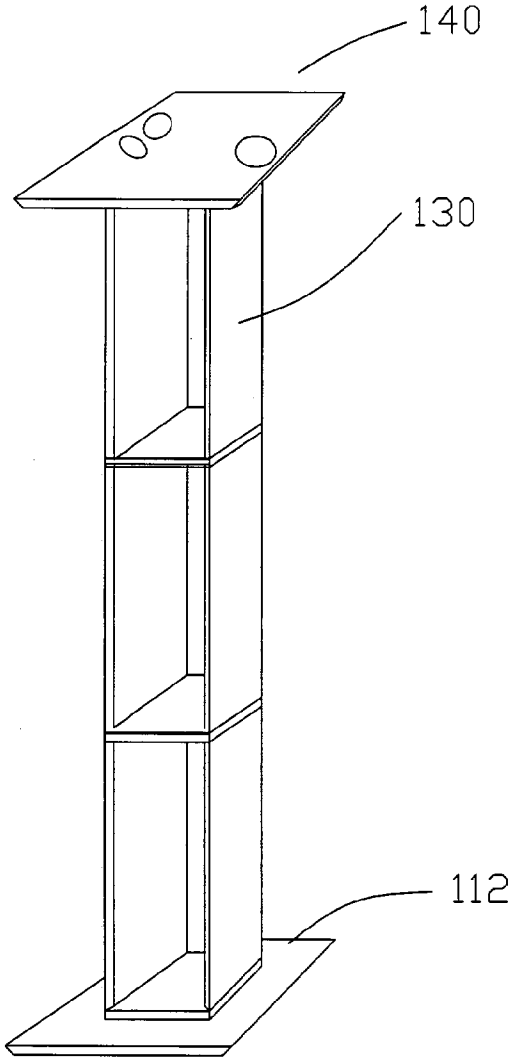
Figure 10:
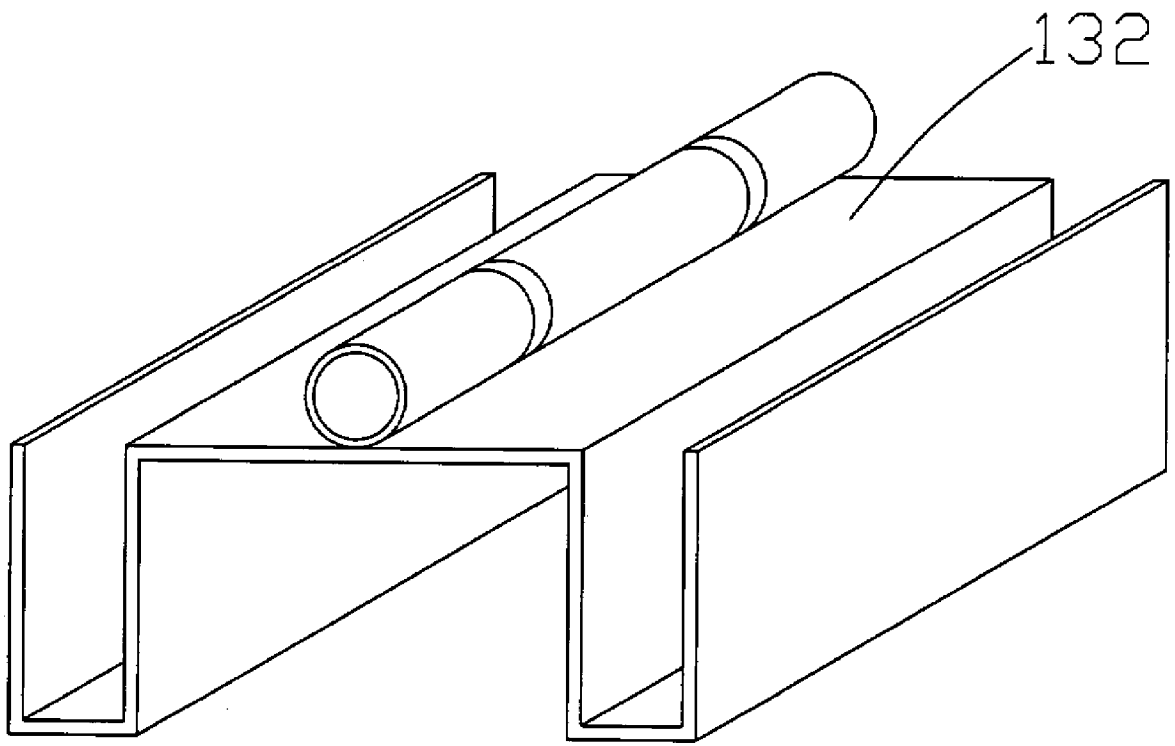
Figure 11:
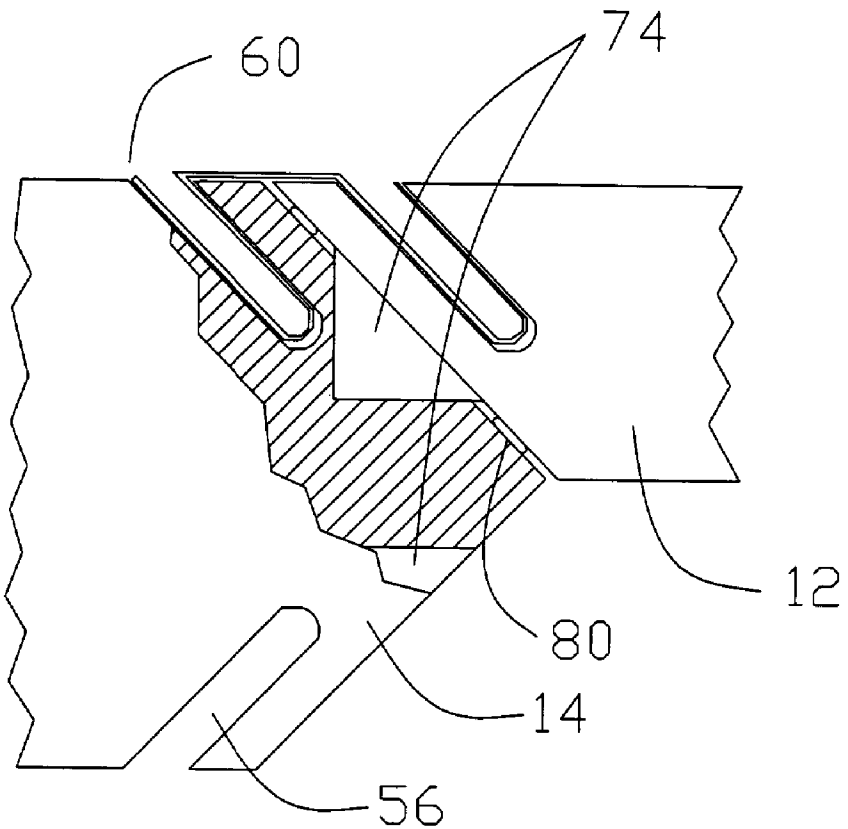

FIGS. 4, 4 (*a*), 4(*b*) and 4 (*c*) are views of a plank;

FIG. 5 is a view of a partial structure under construction;

FIGS. 6 and 6 (*a*) shows a panel;

FIG. 7 shows detail of a plank to panel connection;

FIG. 8 shows a partially exploded view of the detail of a plank to plank connection;

FIG. 9 shows a center support column;

FIG. 10 shows a detail of the hinge clip and;

FIG. 11 shows further detail of the plank to panel connection

DESCRIPTION OF A PREFERRED EMBODIMENT OF THE INVENTION

Figure 1:
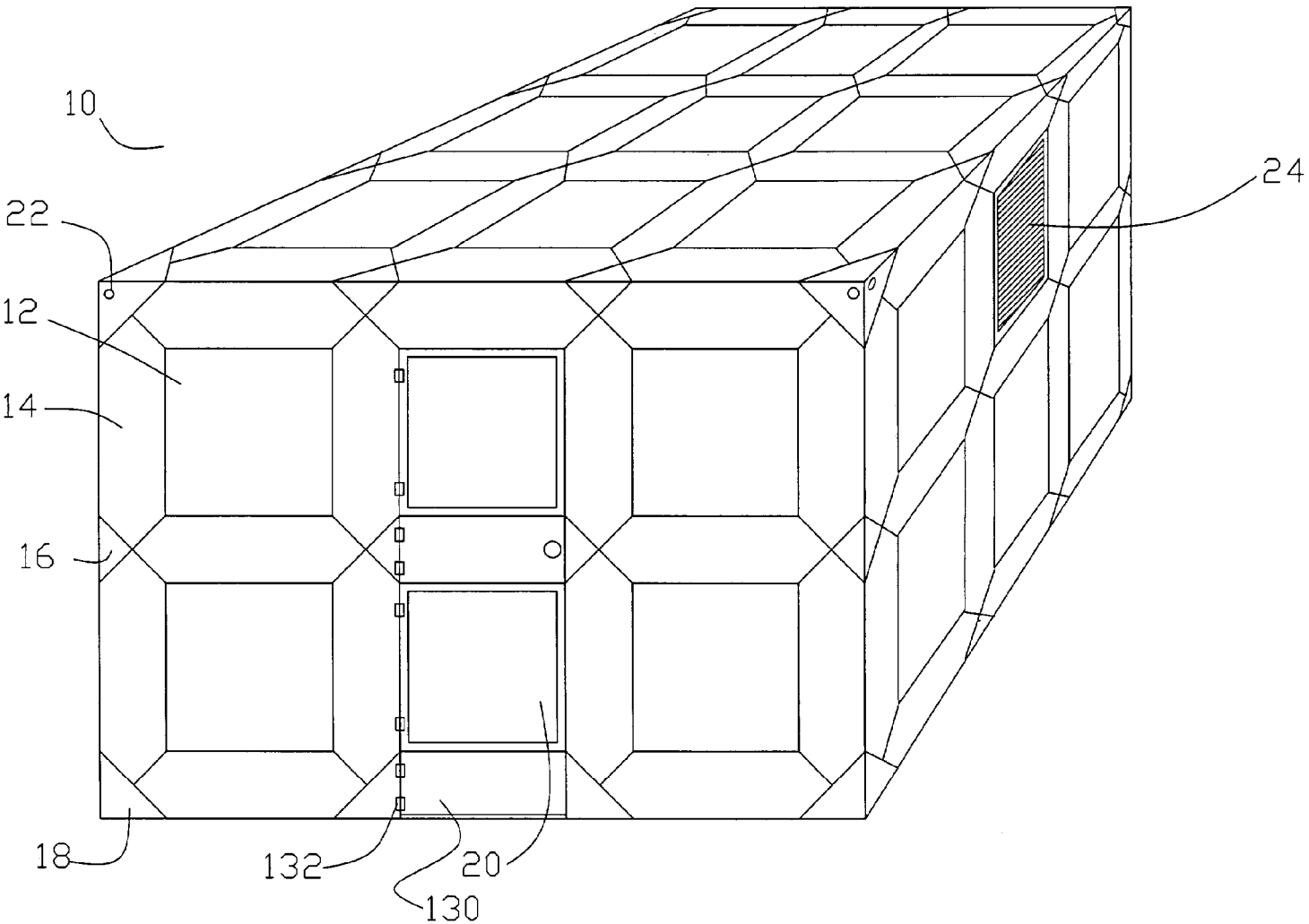
FIG. 1 is a view of a single structure.

FIG. 1 shows a view of the system assembled into a building (10). The basis of the system arises from two basic building pieces, the panel (12) and the plank (14). Panels (12) and planks (14) fit together to form the basic building. In addition there are several special pieces that allow for the construction of a complete system (10). Edge pieces (16) and corner pieces (18) are used with the planks (14) in special areas such as the edges and corners of the building as well as around larger openings such as the door (20). In addition to standard flat panels (12) the system also includes special panels (24). These special panels include fixed or hinged windows, screens or vents. There is also a special panel to allow for the installation of utilities such as electricity, phone lines or water. The corners (18) include a hole (22) that allow for ropes to pass through that can be used to tie the system down if needed. The components of this system could be formed of any material but would most likely be formed from plastic or fiberglass that can be efficiently formed into the shapes needed.

Figure 2:
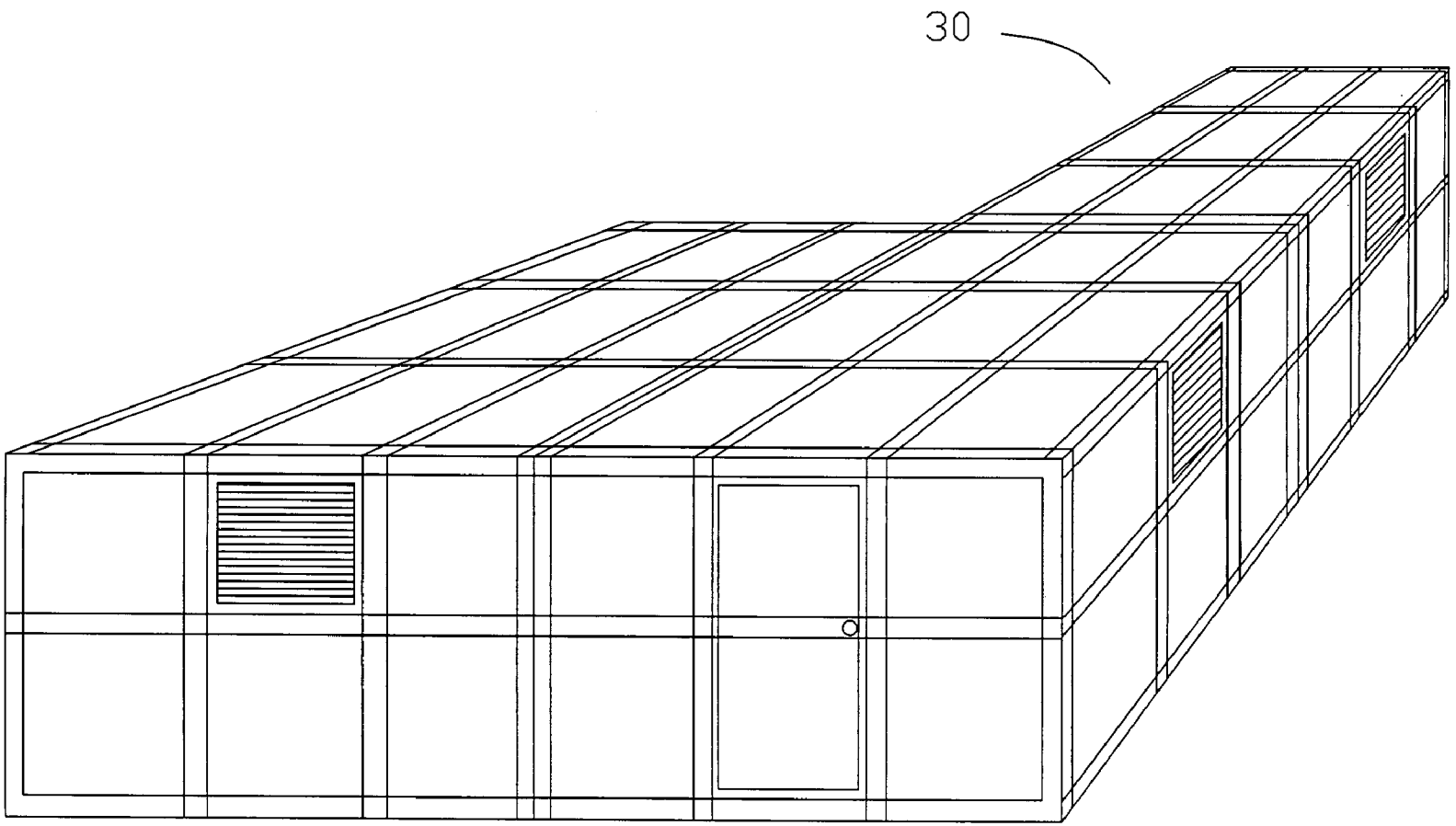
FIG. 2 is a view of three structures combined.

FIG. 2 shows how building sets can be combined to build a larger structure (30). Systems can be combined by placing individual buildings next to each other as shown in FIG. 2 or by combining sets to build one larger structure. Systems can be combined to build structures of differing shape and of different height.

Figure 3:
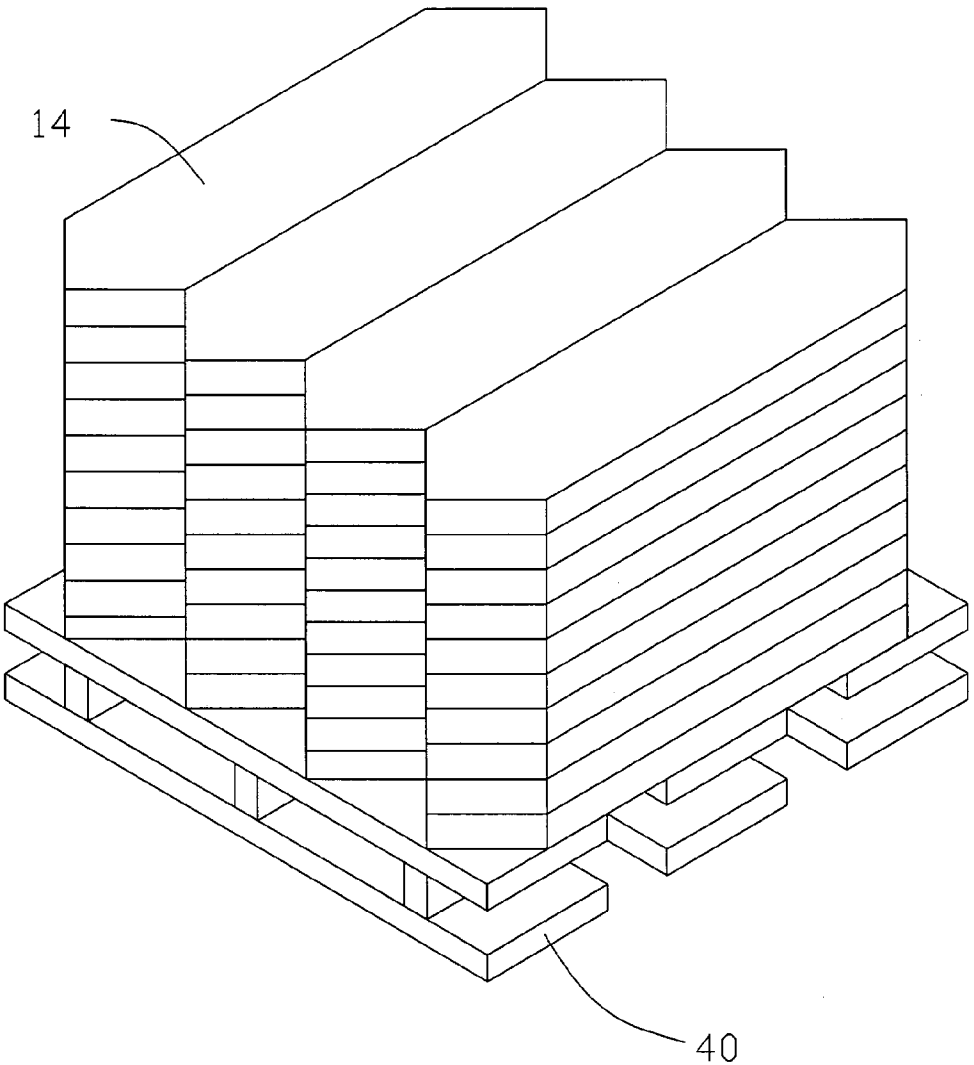
FIG. 3 is a view of parts of the device packaged for shipping.

FIG. 3 shows how the flat planks (14) can be stacked on pallets (40) for shipment to a site for building. The flat panels (12) can be shipped in similar stacks. Though not shown it would also be possible to ship assembled frames (90), see FIG. 5, to a work site as well.

Figure 4C:
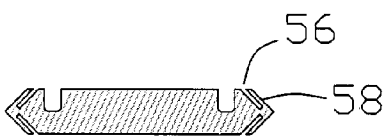
Figure 4A:
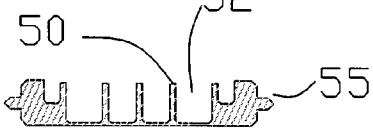
Figure 4B:
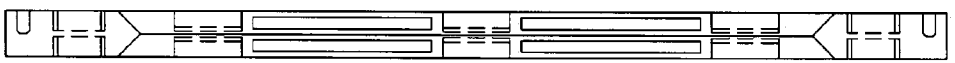

FIG. 4 shows the details of one plank (14). The plank (14) is mostly hollow. Ribs (50) of material create pockets (52) of air space. Four clip pockets (54) allow the plank (14) to be connected to the next adjacent plank. Six clip pockets (56) allow the plank to be connected to a panel (12) or to an adjacent plank (14) on a building edge. FIG. 4*a* shows a cross section of the pockets (52) that reduce weight of the piece. As can be seen in side view 4*b* the plank (14) is relatively flat, FIG. 4*c* shows the chamfered connectors (58) that form pockets (56).

FIG. 5 shows several panels (12), planks (14), an edge piece (16), and a corner piece (18) connected together with clips (60) and (62). The panels (12) and planks (14) have edges beveled at 45 degree angles where they meet whereas the planks (14), edges pieces (16) and corners (18) meet in butt joints. These two types of joints require different types of clips. These clips are shown in FIGS. 7 and 8. Once connected together the panels and planks form a relatively rigid structure. The simplicity of the system is that the panels and planks are universal to the floors, walls and roof of the temporary structure. FIG. 5 also shows a special utility panel (112) that has holes (116) for electrical, communications and plumbing lines to pass through. These lines would need to be trenched in under the structure prior to laying the floor. The utility panel (112) also has a square pocket (118) designed to hold a central roof support column (140) shown in FIG. 9. This optional column would be used in any application where a significant roof load were expected such as in snow. Also shown is a frame (90). The frame (90) consists of four planks (14) clipped together prior to placing the panel (12) in.

FIG. 6 shows the standard panel (12). Like the plank (14) the panel (12) has pockets (70) to reduce the weight and cost of the molded panel. Each panel (12) has twelve clip pockets (72) that allow them to be joined to four planks, one plank (14) on each panel edge. Tabs (74) cooperate with notches (55) in each plank (14) to give the structure its rigidity once the panels (12) are clipped to a planks (14). Optional panels such as window not shown, screen not shown and vent panels (24) would attach in the same way as the standard panels (12). FIG. 6(*a*) shows an edge on view of the standard panel.

FIG. 7 shows a partial edge on view of the connected plank (14) and panel (12). This connection uses clip (60). This view shows gasket or caulk material (80) that can be used to seal joints. Once a panel is connected to the structure, it can be lifted out and changed simply by removing the clips that hold it in place.

FIG. 8 shows a view of two planks (14) ready to be connected. This connection uses the clip (62) which fits into the side by side slots (54) on the two planks.

FIG. 9 shows the roof support column (140) that can be built up from special planks (130) that are also used to build the door (20). The roof support column (140) cooperates with pockets (118) in special utility panels (112) in the floor and roof.

FIG. 10 shows the hinged clip (132) used to support the door (20).

FIG. 11 shows detail on the panel to plank joint. Specifically it shows how the tabs (74) cooperate with the notches (55) to create a stable connection between the two elements.

In operation, the structure is set up by first clearing a flat area of ground approximately large enough for 9 panel squares. Starting with the floor, lay four planks (14) on the ground in the center of the area and connect together using clips (62) to form a first frame. Add three more planks (14) to one side to make another frame, and so on until a three by three frame square floor is created using twenty four planks (14) and thirty six clips (62). Then nine panels (12) are set in the frames and clipped in place using 108 clips (60). If needed the utility panel (112) replaces one of the nine standard panels (12) in the floor. This completes the floor. Then two additional four plank frames (90) are created off to the side. In one corner of the floor these two frames (90) are placed to create a corner as shown in FIG. 5. Repeating this process around the base creates the walls on all four sides. Gaps created around the perimeter of the floor are filled with corner pieces (18) and edge pieces (16) as shown in FIG. 5. Then a second layer of planks (14) and panels (12) are added to complete the walls. Window and vent panels can be substituted where desirable for the standard panels (12).

To build the system roof, connect four planks (14) to make a frame (90) and place it in a top corner, repeat for each of four top corners. Then complete a fifth frame of four planks (14) and connect it to each frame in the roof corners. This creates a self supporting roof plank system to which the rest of the panels (12) can be added to complete the roof. Again corners (18) and edges (16) fill in the gaps along the perimeter. Although the roof system is self supporting, the embodiment shown in FIG. 5 includes the provision for a utility panel (112) having a central aperture (118) that allows the user to erect a central post 140 under the roof. This will keep the roof from sagging under a snow load for example. Also as shown in FIG. 7, caulking or gasket material (80) can be placed at any seam to prevent leaking.

If desired a door (20) can be installed. Use two door planks (130) and two panels (12) to make the door (20) and connect in place using hinged clips (132). Although a special utility panel (112) is shown, that panel could be created by cutting holes (116) and pocket (118) in a standard panel (12). Also it will be understood that standard pre-hung doors, support columns and windows could be attached to the system instead of using the special pieces shown.

Though shown with nine panels making up the floor and with the walls as two frames high it would be obvious to use various size frames and different numbers of frames to make and infinite variety of sizes and shapes of building based on the basic building shown.

What is claimed is:

1. A building system including a relatively flat square panel having a side length, a first plank having a first edge the same length as said panel side length, a first clip and a first slot on said panel and a second slot on said first plank that are clipped together with said first clip, a first extended portion of said first plank extending beyond said panel side length such that a second plank on an adjacent side of said panel is joined by a second clip to form a rigid frame of planks surrounding said panel and wherein said plank extended portion has a third slot to accommodate said second clip wherein the first plank has a second edge parallel to said first edge and wherein said first plank has a second extending portion on an end of said first plank opposite said first extending portion; and wherein said first and second extending portions consist of a triangular portion having slotted legs.

2. The building system of claim 1 wherein said first clip and said second clip are made from spring steel.

3. The building system of claim 1 wherein the first and second edge of each plank is chamfered at 45 degrees such that a right angled edge for said building system can be built by placing two planks adjacent to one another at a right angle.

4. The building system of claim 1 wherein the plank and panel are molded and include weight reducing pockets void of material and separated by strengthening ribs.

5. A building system including a plurality of relatively flat square panels each having a side length, a plurality of planks each having a first and second edge the same length as said panel side length, a first slot on each said panel and a second slot on each said plank, each said panel connected by a first clip to said first edge of one of said planks, a first extended portion of said plank extending beyond said panel side length such that planks on adjacent sides of each said square panel meet in butt joints and are joined by a second clip to form a rigid frame of planks surrounding each said panel and wherein said panel side lengths and said plank first and second edges are chamfered with 45 degrees faces and wherein said 45 degree faces include tabs and notches to strengthen said frame once the panel is inserted.

6. The building system of claim 5 wherein the system is assembled by first clipping together 4 said planks to form a frame around an opening and then inserting one of said panels into said opening and clipping it to each of the 4 said planks.

7. The building system of claim 6 including a floor assembled from nine of said frames.

8. The building system of claim 7 wherein one of said panels is a special panel to allow for utility connections into the building system.

9. The building system of claim 5 wherein the planks on adjacent sides of each said panel meet at a 45 degree angle adjacent to a corner of said panel and wherein the planks are connected by a spring steel clip.

10. The building system of claim 9 wherein caulk is used to seal a joint created where said planks meet.

11. A building system including a plurality of relatively flat square frames, each square frame having a side length, each frame made up of four planks clipped together to form said frame with an opening and a square panel to fit in said opening, a plurality of first slots on each edge of said panel and a plurality of second slots on each said plank, said panel connected by a first set of clips to a first edge of each of said four planks, a first extended portion of each said plank extending beyond a panel side length such that the planks on adjacent sides of each said square panel meet and are joined by a second set of clips to form a rigid frame of planks surrounding each said panel and wherein each said plank has 6 sides on a face and a thickness, wherein the 6 sides include the first edge and a second edge spaced and parallel to said first edge, and a first two shorter sides forming a 45 degree angle on one end of said plank and a second two shorter sides forming a second 45 degree angle on an opposite end of said plank and wherein said planks on adjacent sides of each said square panel are joined by said second set of clips.

12. The building system of claim 11 wherein said frames are joined at their edges to create a floor, walls and a roof.

13. The building system of claim 12 wherein panels in said walls include screens to allow for air to pass through said walls.

14. The building system of claim 12 wherein edge and corner pieces are used to create a portion of an edge between said floor and each of said walls.

15. The building system of claim 11 wherein said panels and said planks are shipped to a building site on pallets.

16. The building system of claim 11 wherein the panels and planks are molded.

* * * * *